United States Patent [19]

Webb

[11] Patent Number: 4,770,244

[45] Date of Patent: Sep. 13, 1988

[54] DOWNHOLE FIXED CHOKE FOR STEAM INJECTION

[75] Inventor: Charles H. Webb, Bakersfield, Calif.

[73] Assignee: Chevron Research Company, San Francisco, Calif.

[21] Appl. No.: 70,671

[22] Filed: Jul. 1, 1987

Related U.S. Application Data

[63] Continuation of Ser. No. 878,086, Jun. 24, 1986, abandoned.

[51] Int. Cl.[4] ..... E21B 43/24

[52] U.S. Cl. ..... 166/117.5; 166/242; 166/269; 166/303

[58] Field of Search ..... 166/117.5, 269, 242, 166/313, 250, 272, 222, 316, 243, 303, 373, 57

[56] References Cited

U.S. PATENT DOCUMENTS

| | | | |
|---|---|---|---|
| 2,973,039 | 2/1961 | Payne, Jr. | 166/269 |
| 3,130,784 | 4/1964 | Pennington II | 166/269 |
| 3,455,382 | 7/1969 | Chenoweth | 166/269 |
| 3,802,503 | 4/1974 | McGinn | 166/117.5 |
| 4,011,906 | 3/1977 | Alexander et al. | 166/303 |
| 4,197,909 | 4/1980 | Terral | 166/117.5 |
| 4,399,865 | 8/1983 | Anderson et al. | 166/303 |
| 4,424,859 | 1/1984 | Sims et al. | 166/313 |
| 4,541,482 | 9/1985 | Johnston | 166/242 |
| 4,646,828 | 3/1987 | Schwab, Jr. et al. | 166/117.5 |

*Primary Examiner*—Jerome Massie
*Assistant Examiner*—Bruce M. Kisliuk
*Attorney, Agent, or Firm*—S. R. La Paglia; E. J. Keeling; E. A. Schaal

[57] ABSTRACT

A downhole fixed choke mandrel apparatus for steam injection is described. The apparatus permits the dividing of the injection of a non-compressible fluid into two portions for injection into different producing zones separated by non-producing strata such that the quantity and quality of the injected material can be adequately derived and monitored. The apparatus further provides for the logging through the injection tubing string above and below the first injection into the first producing zone.

6 Claims, 1 Drawing Sheet

DOWNHOLE FIXED CHOKE FOR STEAM INJECTION

This application is a continuation of application Ser. No. 878,086, filed June 24, 1986, now abandoned.

FIELD OF THE INVENTION

This invention relates to compressible fluid injection such as steam injection. More specifically, this invention relates to downhole steam chokes for the injection of a compressible fluid through a single tubing string into multiple producing zones.

BACKGROUND OF THE INVENTION

Many hydrocarbon-producing fields contain hydrocarbons of sufficiently high viscosity that the hydrocarbons do not flow freely toward a production well. The movement of these hydrocarbons toward a production well is assisted by the injection of steam to heat the formation and reduce the viscosity of the hydrocarbons, thus permitting them to flow toward the production well. Many of these fields contain different hydrocarbon-producing formations or zones which are separated by non-producing formations. It is often desirable to simultaneously produce hydrocarbons from these different zones. In order to maximize the efficiency of the operation and minimize costs, it is desirable to inject steam only into those portions of the formation that contain hydrocarbons.

If the wellbore casing is sufficiently large, individual injection tubing strings can be run into the wellbore to the desired formation so that the compressible injected fluid, such as steam, nitrogen, carbon dioxide and the like, is directed toward the specific producing zone of interest. However, many wellbores have a sufficiently small diameter that only a single tubing string can be inserted into the casing. When such wells penetrate formations having different producing zones, it may be prohibitively expensive to redrill the well in order to put separate injection tubing strings within the casing. Thus, it is highly desirable to have a method of simultaneously injecting steam of a known quality and quantity into different and separate producing zones so as to maximize the production from these individual formations.

U.S. application Ser. No. 716,292, now U.S. Pat. No. 4,640,355, titled "Limited Entry Method For Multiple Zone Compressible Fluid Injection", filed Mar. 26, 1985, discloses an apparatus and method for using downhole critical flow chokes that permit the accurate determination of the quality and quantity of steam injected into a particular producing zone. Although the application describes the overall concept for implementing the injection of known quantities and qualities of steam in separate formations, it would be highly desirable to have a particular apparatus for use in a single tubing string that would permit the injection of steam into different producing zones while permitting the running of logging tools or other instruments into and out of the injection tubing string to determine parameters of the surrounding formation so that the injection of the compressible fluid, its composition quality and quantity can be optimized to minimize costs and maximize production from a particular producing zone.

SUMMARY OF THE INVENTION

I have invented a downhole fixed choke mandrel for compressible fluid injection, particularly for wet steam, which permits the accurate splitting of quality and quantity of the compressible fluid between two separate producing zones while permitting the continued logging of the formation through the tubing string.

DETAILED DESCRIPTION OF THE INVENTION

Figure 1:
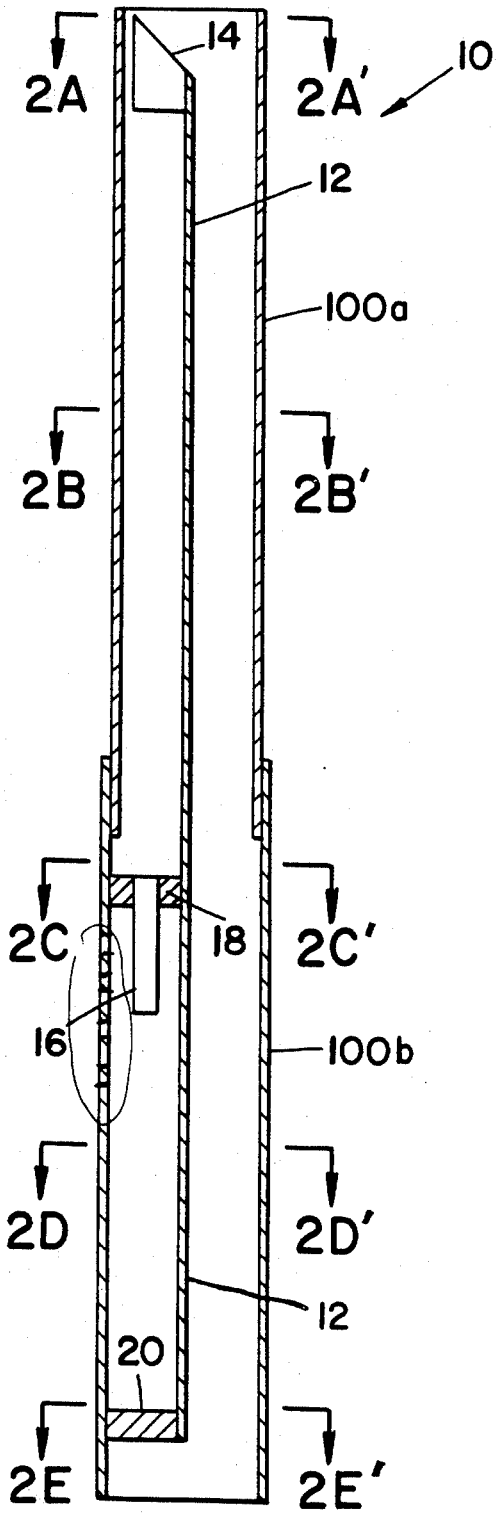
FIG. 1 illustrates a cross-sectional view of the apparatus of the invention.
Figure 2A:
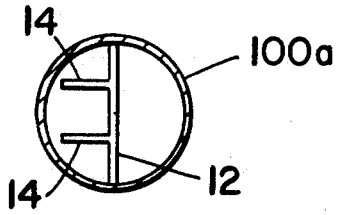
FIGS. 2A–E illustrate cross-sectional views along the lines A/A' through E/E' in FIG. 1.
Figure 2B:
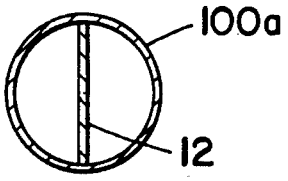
Figure 2C:
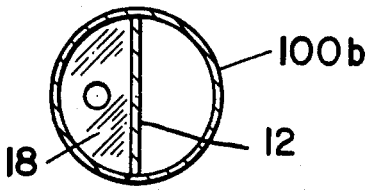
Figure 2D:
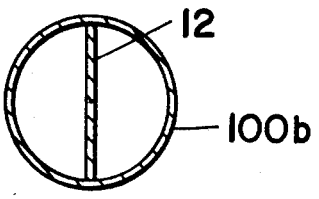
Figure 2E:
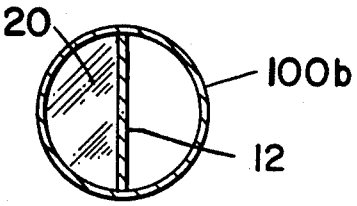

The invention will be more clearly illustrated by referring to the Figures. FIG. 1 illustrates a cross-sectional view of the mandrel and choke apparatus 10. FIGS. 2A–E illustrates cross section of the mandrel and choke apparatus 10 perpendicular to longitudinal axis. FIG. 1 and FIGS. 2A–E should be viewed in conjunction with the following description.

As the compressible fluid, such as wet steam or a non-condensible gas and an aqueous phase, is injected into the injection tubing string at the surface, the material can segregate out between a vapor phase and a liquid phase as the mixture travels down the wellbore. The liquid phase tends to segregate out along the interior surface of the tubing string keeping the vapor phase in the center of the tube.

To adequately divide the materials, it is necessary to insert a dividing plate 12 in those sections of the tubing string 100A and 100B which will contain the mandrel choke apparatus 10. The dividing plate 12 splits the injection tubing into two semi-cylindrical sections. Of course, the dividing plate can be configured to form shapes other than semi-cylindrical sections, such as quarter-sections, without adversely effecting the rate and quality of the injected steam.

This dividing plate is superior to merely inserting a tube within a tube over that section of the injection tubing string 100 which contains the choke in order to obtain a cross section having a smaller cylinder offset from within the larger tubing string cylinder.

To permit the logging of the wellbore surrounding formation through the injection tubing string, the injection tubing string contains a means for kicking over well logging tools to the portion of the tubing adjacent A' through E' numbered 14. This kickover plate 14 is sized and angled so as to direct logging tools down that portion of the injection tubing strings 100A and 100B formed between dividing plate 12 and that portion of the injection tubing strings 100A and 100B adjacent A' through E'.

The choke 16 is centered in a plate 18 about 4 feet below the kickover plate 14. The dividing plate 12 can be any length from about 6 inches to 20 feet, although 4 feet for standard section mandrel tubing is appropriate. The choke 16 can be any standard critical flow device selected to optimize the quantity and quality of steam to be injected into the formation. Plate 18 is provided to threadedly engage choke 16, although the choke could be welded thereto if removal is not desired. The area into which the steam is to be injected is defined at the downhole portion of the wellbore by plate 20, sealing dividing plate 12 to the injection tubing string 100B.

The volume chamber is sized so as not to create excessive steam velocities exiting the chamber which would cause erosion of the casing and the steam exiting slots. The injection tubing 100B, that area forming a volume chamber adjacent to choke 16 contains slotted perforations through which the steam exits into the wellbore casing and through perforations from the casing out into the formation which is to be steamed.

Of a general nature, the mandrel choke assembly consists of an upper and lower portion, the upper portion being defined by that portion of the injection tubing enumerated as 100A and the lower portion enumerated as 100B. The lower portion 100B consists of an outer tubular steel which is divided in half by thin rectangular steel plate 12. The plate is welded along the sides of the inside of the tubing so that a seal was made between the halves of the tubing. Two semi-circular steel spacers 18 and 20 are placed inside the tube on the same side of the partition but at opposite ends and welded to both the tube 100B and the partition plate 12 so that the areas on either side of the partition plate 12 are completely segregated from each other. The choke is, for example, a standard Thornhill-Craver choke and is screwed into the threaded opening on the top spacer 18 in such a way that its length is parallel to the tube 100A and the partition plate 12. The lower tube 100B is perforated on the side containing the spacers and the choke so that fluid injected through the choke will be able to exit out to the side of the tube.

The ends of the outer tube are threaded so that they screw into tubing 100A such as commonly used in steam injection wells. The upper part 100A of the mandrel consists of a thin rectangular steel plate 12 that protrudes upwardly and fits snugly into the tubing 100. It divides the tubing as equally as possible into two halves, yet does not necessarily form a perfect seal between them.

A mandrel/choke combination of the above description having an overall length of about 10 feet between the two sections was suitable for dividing an initially injected quantity of steam of about 580 barrels per day's cold water equivalent having a quality of about 70% into an upper and lower injection rate of about 270 and 310 barrels per day cold water equivalent of steam with a steam quality split of 60% and 58%, respectively. Thus, a mandrel choke apparatus with similar chokes is suitable for dividing a single injection stream of steam into two or more separate streams of substantially equal steam quality and substantially equal output rate. In addition, the use of different choke sizes would enable a single injection tubing string to be used to steam different formations which require different steam quantities but approximately the same steam quality. Of course, the rate and quantity split could be partitioned unequally by changing the choke size in the mandrel choke assembly.

The invention has been described with respect to particularly preferred embodiments. Modifications which would be obvious to the ordinary skilled artisan are contemplated to be within the scope of the invention.

What is claimed is:

1. A downhole fixed choke mandrel apparatus in a steam injection system comprising:

a tube;

a dividing plate means for dividing said tube into predetermined volumetric spaces and for splitting injected steam into at least two sections of substantially equal steam quality;

directing means connected to said dividing plate at one end of a first section of said divided tube for directing logging tools away from said first section;

means for obtaining the flow of a fluid under sonic flow conditions within said first section; and means for sealing the end of said first section opposite to the end of said first section connected to said directing means.

2. The apparatus according to claim 1 wherein said directing means is a kickover plate.

3. The apparatus according to claim 2 wherein said means for obtaining sonic flow conditions is a choke.

4. A downhole fixed choke mandrel apparatus in a steam injection system comprising:

a tube;

a dividing plate for dividing said tube into two semi-cylindrical sections;

a kickover plate connected to said dividing plate at one end of a first section of said divided tube for directing logging tools away from said first section;

a choke for obtaining the flow of a fluid under sonic flow conditions within said first section; and means for sealing the end of said first section opposite to the end of said first section connected to said kickover plate.

5. The apparatus according to claim 4 wherein said dividing plate divides said tubing into predetermined volumetric spaces having a length of from about 6 inches to about 10 feet from the position wherein said choke is positioned in one of said volumetric spaces.

6. The apparatus according to claim 5 wherein said dividing plate is about 4 feet in length from said kickover plate to said choke.

* * * * *